US008704662B2

(12) United States Patent
Mahmoud et al.

(10) Patent No.: US 8,704,662 B2
(45) Date of Patent: Apr. 22, 2014

(54) METHOD AND APPARATUS FOR MONITORING A STRUCTURE

(75) Inventors: Seedahmed Mahmoud, Dandenong (AU); Colin Kemp, Mt. Eliza (AU); Alexander Adams, Murrumbeena (AU); Jim Katsifolis, Northcote (AU)

(73) Assignee: Future Fibre Technologies Pty Ltd, Mulgrave, Victoria (AU)

( * ) Notice: Subject to any disclaimer, the term of this patent is extended or adjusted under 35 U.S.C. 154(b) by 838 days.

(21) Appl. No.: 12/594,266

(22) PCT Filed: Mar. 26, 2008

(86) PCT No.: PCT/AU2008/000420

§ 371 (c)(1),
(2), (4) Date: Nov. 12, 2009

(87) PCT Pub. No.: WO2008/119107

PCT Pub. Date: Oct. 9, 2008

(65) Prior Publication Data

US 2010/0073163 A1 Mar. 25, 2010

(30) Foreign Application Priority Data

Apr. 2, 2007 (AU) ..... 2007901755
Aug. 2, 2007 (AU) ..... 2007904158

(51) Int. Cl.
*G08B 13/08* (2006.01)

(52) U.S. Cl.
USPC ..... 340/545.3; 340/545.2; 340/541; 340/540; 250/227.14; 356/477; 356/450; 398/33; 398/13

(58) Field of Classification Search
USPC ..... 340/540, 541, 545.2, 545.3, 545.4, 552, 340/555; 702/190; 356/477, 450; 385/12; 398/33, 20, 16, 13; 250/227.14
See application file for complete search history.

(56) References Cited

U.S. PATENT DOCUMENTS

| | | | | |
|---|---|---|---|---|
| 5,355,208 | A | 10/1994 | Crawford et al. | |
| 5,510,765 | A | 4/1996 | Madau | |
| 5,691,697 | A | 11/1997 | Carvalho et al. | |
| 6,621,947 | B1 | 9/2003 | Tapanes et al. | |
| 6,642,846 | B1 * | 11/2003 | Krubiner et al. | 340/545.3 |
| 6,720,875 | B2 | 4/2004 | Philippe | |
| 6,778,717 | B2 | 8/2004 | Tapanes et al. | |
| 7,019,649 | B2 | 3/2006 | Hoenig | |
| 2003/0030557 | A1 * | 2/2003 | Progovac et al. | 340/511 |
| 2003/0198425 | A1 * | 10/2003 | Tapanes et al. | 385/12 |
| 2005/0231353 | A1 * | 10/2005 | DiPoala et al. | 340/522 |
| 2006/0163457 | A1 | 7/2006 | Katsifolis et al. | |

OTHER PUBLICATIONS

PCT/AU2008/000420 International Search Report.

* cited by examiner

*Primary Examiner* — Steven Lim
*Assistant Examiner* — Hongmin Fan
(74) *Attorney, Agent, or Firm* — Michael Best & Friedrich LLP

(57) ABSTRACT

A system and method for monitoring a structure and for distinguishing between an alarm condition, and a nuisance event such as rain. An optical fibre sensor (20,22) produces a signal indicative of a disturbance and level crossing rates are determined to distinguish between noise in the signal (nuisance event) and a required event. A FFT technique is also disclosed as well as classification of an event by extracting predetermined features from the signal.

8 Claims, 12 Drawing Sheets

METHOD AND APPARATUS FOR MONITORING A STRUCTURE

FIELD OF THE INVENTION

The present invention relates to a method and apparatus for monitoring a structure and, in particular, but not exclusively, to monitoring a barrier to determine an intrusion across the barrier. The barrier may be a fence or other partition, or a region of the ground. In other embodiments, the structure may be other than a barrier or region of the ground which is to be monitored for intrusion and may comprise a mechanical device or the like, a communication network, or other machine.

BACKGROUND OF THE INVENTION

One of the challenges of all sensing systems is to be able to operate in a number of hostile environments. Intrusion detection systems, which are often installed in outdoor environments and need to operate during periods of heavy wind or rain, or close to nearby traffic crossings, are no exception.

In any sensing system, a nuisance alarm can be defined as an alarm caused by an event that is not of interest for that sensing system. For intrusion detection systems, this relates to non-intrusion events such as wind, rain, vehicular traffic and other environmentally related non-intrusion events. Nuisance alarms can adversely affect the performance of intrusion detection systems, as well as the confidence of the system operator. The minimization of the nuisance alarm rate of intrusion detection systems, and indeed of any sensing system, is therefore critical for its successful performance and confidence of operation.

An important part of nuisance alarm handling involves being able to recognize the nuisance event being detected by the sensing system, as well as being able to discriminate between nuisance events and intrusion events. A number of different signal processing techniques can be used to achieve this and can range from simple filtering techniques, to adaptive filtering techniques, to a number of time-frequency analyses. The crux of all event recognition and discrimination techniques is the signal classification process, which involves extracting and identifying unique features in event signals. The event signals may represent isolated individual events (for example intrusion, rain, wind or traffic), or a number of events occurring simultaneously (for example, an intrusion event during heavy rain). In this latter case of simultaneously occurring events, an effective technique for extracting the event of interest from the event of non-interest is required.

In some instances it is also desirable to be able to classify the particular type of nuisance event.

The intrusion detection system may be of the type described in U.S. Pat. Nos. 6,621,947 and 6,778,717, and U.S. patent application Ser. No. 11/311,009. It is based on a bidirectional Mach Zehnder (MZ) which can be used as a distributed sensor to detect and locate a perturbation anywhere along its sensing arms. It will be referred to as a locator sensor. The content of these patents and the application are incorporated into this specification by this reference.

SUMMARY OF THE INVENTION

The object of a first aspect of the invention is to provide method and apparatus for distinguishing between an event of interest and a nuisance event.

The present invention provides apparatus for monitoring a structure comprising:

- a sensing device for producing a detected signal for determining a change in or to the structure; and
- a processor for processing the detected signal to determine level crossing rates in the signal and, from those rates, distinguishing between noise in the signal indicative of a nuisance event and a required event.

The sensing device may be comprised of a number of different technologies, such as electrical devices, acoustic or seismic devices, or optical devices.

In the preferred embodiment of the invention the sensing device comprises:

- a light source;
- a waveguide for receiving light from the light source so that light is caused to propagate through the waveguide; and
- a detector for detecting the light propagating through the waveguide to determine a change in the monitored structure, and for producing the detected signal.

Preferably the processor is for defining a plurality of block durations of a predetermined time interval, setting a noise level threshold, monitoring the number of level crossings exceeding the noise level threshold per block duration for a predetermined noise detection duration period comprised of a number of block durations, setting a noise amplitude variation being a predetermined number of level crossings per block, so that if the number of level crossings in a noise detection duration does not vary by more than the noise amplitude variation, the signal over the noise detection duration period is regarded as a nuisance event.

Preferably the processor is also for establishing an event threshold level which is a number of level crossings per noise detection duration period above the noise amplitude variation so that if the number of level crossings in one or more block duration periods is above the event threshold level, a required event is regarded having occurred.

Preferably the event threshold is a dynamic threshold and changes relative to the background nuisance level dependent on the nuisance events detected by the processor.

Preferably the processor determines the event threshold level so that the event threshold level is equal to the sum of the maximum number of level crossings over the last noise detection duration period and event threshold margin.

Preferably the event threshold margin is a predetermined margin.

Preferably the processor is also for generating an alarm when a required event is detected.

The invention also provides a method of monitoring a structure comprising:

- monitoring a change in the structure by a sensing device to provide a detected signal; and
- processing the detected signal to determine level crossing rates and for distinguishing between a nuisance event and a required event based on the level crossing rates.

Preferably the monitoring step comprises launching light into a waveguide and detecting light from the waveguide to provide a detected signal.

Preferably the method further comprises defining a plurality of block durations of a predetermined time interval, setting a noise level threshold, monitoring the number of level crossings over the noise level threshold per block duration for a predetermined noise detection duration period comprised of a number of block durations, setting a noise amplitude variation being a predetermined number of level crossings per block, so that if the number of level crossings in a noise detection duration does not vary by more than the noise amplitude variation, the signal over the noise detection duration period is regarded as a nuisance event.

Preferablyy the method establishes an event threshold level which is a number of level crossings per noise detection duration period above the noise amplitude variation so that if the number of level crossings in one or more block duration periods is above the event threshold level, a required event is regarded having occurred.

Preferably the event threshold is a dynamic threshold and changes relative to the background nuisance level dependent on the nuisance events detected by the processor.

Preferably the method determines the event threshold level so that the event threshold level is equal to the sum of the maximum number of level crossings over the last noise detection duration period and event threshold margin.

Preferably the event threshold margin is a predetermined margin.

Preferably the method generates an alarm when a required event is detected.

The invention also provides a system for monitoring a structure comprising:

a sensing device for producing a detected signal for determining a change in or to the structure; and a processor for processing the signal detected by the detector to distinguish between nuisance events and the required event, the processor establishing an event threshold and dynamically varying the event threshold dependent upon a nuisance signal level in the detected signal so that in order to determine a required event the signal detected by the detector exceeds the dynamic event threshold.

In one embodiment the method further comprises defining a plurality of block durations of a predetermined time interval, setting a noise level threshold, monitoring the number of level crossings in the detected signal over the noise level threshold per block duration for a predetermined noise detection duration period comprised of a number of block durations, setting a noise amplitude variation being a predetermined number of level crossings per block, so that if the number of level crossings in a noise detection duration does not vary by more than the noise amplitude variation, the signal over the noise detection duration period is regarded as a nuisance event.

In another embodiment of the invention the processor is for determining the occurrence of a required event from the processing of the detected signal to determine level crossing rates to produce a signal indicative of a combined nuisance event and required event, and a signal indicative of only the nuisance event, the processor being for performing a fast Fourier transform on both signals to convert the signals to the frequency domain, removing selected frequencies in the signal indicative of only the nuisance event from the combined nuisance and event signal to produce a signal containing only event data to enable an intrusion event to be determined.

Preferably the sensing device comprises:

a light source;

a waveguide for receiving light from the light source so that light is caused to propagate through the waveguide; and a detector for detecting the light propagating through the waveguide to determine a change in the monitored structure so an event alarm can be generated indicative of the occurrence of a required event and for producing a detected signal.

Preferably the occurrence of an event to produce the combined nuisance and event signal is determined by the processor by the number of level crossings exceeding an event threshold.

Preferably the signal indicative of the nuisance event is determined from a duration of the signal in which no required event is present.

In the preferred embodiment of the invention the required event is an intrusion on or over the structure.

In the preferred embodiment of the invention the method and apparatus also locates the location of the intrusion from counter-propagating optical signals launched into the waveguide and the time difference between receipt of modified counter-propagating signals which are modified by the event.

The invention also provides a method of monitoring a structure comprising:

monitoring a change in the structure by a sensing device to provide a detected signal; and establishing an event threshold and dynamically varying the event threshold dependent upon a nuisance signal level in the detected signal so that in order to determine a required event the signal detected by the detector exceeds the dynamic event threshold.

Preferably the monitoring step comprises:

launching light into a waveguide so that light is caused to propagate through the waveguide; and detecting the light propagating through the waveguide to determine a change in the monitored structure indicative of the occurrence of a required event and for producing a detected signal.

In one embodiment the method further comprises defining a plurality of block durations of a predetermined time interval, setting a noise level threshold, monitoring the number of level crossings in the detected signal over the noise level threshold per block duration for a predetermined noise detection duration period comprised of a number of block durations, setting a noise amplitude variation being a predetermined number of level crossings per block, so that if the number of level crossings in a noise detection duration does not vary by more than the noise amplitude variation, the signal over the noise detection duration period is regarded as a nuisance event.

In another embodiment the method further comprises determining level crossing rates to produce a signal indicative of a combined nuisance event and required event, and a signal indicative of only the nuisance event, performing a fast Fourier transform on both signals to convert the signals to the frequency domain, removing selected frequencies in the signal indicative of only the nuisance event from the combined nuisance and event signal to produce a signal containing only event data to enable an intrusion event to be determined.

Preferably the occurrence of an event to produce the combined nuisance and event signal is determined by the number of level crossings exceeding an event threshold.

Preferably the signal indicative of the nuisance event is determined from a duration of the signal in which no required event is present.

In the preferred embodiment of the invention the required event is an intrusion on or over the structure.

In the preferred embodiment of the invention the method and apparatus also locates the location of the intrusion from counter-propagating optical signals launched into the waveguide and the time difference between receipt of modified counter-propagating signals which are modified by the event.

This aspect of the invention may also be said to reside in an apparatus for monitoring a structure comprising:

a sensing device for producing a detected signal for determining a change in or to the structure; and a processor for producing from said detected signal a signal indicative of a combined nuisance event and required event, and a signal indicative of only the nuisance event, the processor being for performing a fast Fourier transform on both signals to convert the signals to the frequency domain, removing selected frequencies in the signal indicative of only the nuisance event from the combined nuisance and event signal to produce a signal containing only event data to enable the presence of a required alert event to be determined.

Preferably the sensing device comprises:

a light source;

a waveguide for receiving light from the light source so that the light is caused to propagate through the waveguide; and a detector for detecting the light propagating through the waveguide to determine a change in the monitored structure so an event alarm can be generated indicative of the occurrence of a required event and for producing the detected signal.

Preferably the processor determines the signal indicative of a combined nuisance event and required event by determining the number of level crossings in the detected signal exceeding an event threshold.

Preferably the processor determines the signal indicative of the nuisance event from duration of the detected signal in which no required event is present This aspect of the invention may also be said to reside in a method of monitoring a structure comprising:

monitoring a change in the structure by a sensing device to provide a detected signal; and producing from said detected signal a signal indicative of a combined nuisance event and required event, and a signal indicative of only the nuisance event, the processor being for performing a fast Fourier transform on both signals to convert the signals to the frequency domain, removing selected frequencies in the signal indicative of only the nuisance event from the combined nuisance and event signal to produce a signal containing only event data to enable the presence of a required alert event to be determined.

Preferably the monitoring step comprises:

launching light into a waveguide so that the light is caused to propagate through the waveguide; and detecting the light propagating through the waveguide to determine a change in the monitored structure so an event alarm can be generated indicative of the occurrence of a required event and for producing the detected signal.

Preferably the method determines the signal indicative of a combined nuisance event and required event by determining the number of level crossings in the detected signal exceeding an event threshold.

Preferably the method determines the signal indicative of the nuisance event from duration of the detected signal in which no required event is present An object of a second aspect of the invention is to be able to classify various events in a method and system for monitoring a structure to determine the occurrence of a required event.

This aspect of the invention may be said to reside in an apparatus for monitoring a structure to determine the occurrence of a required event, comprising:

a sensing device for producing a detected signal for determining a change in or to the structure; and a processor for processing the detected signal and extracting predetermined features from the detected signal so that the classification of an event type can be determined from the predetermined features.

Preferably the sensing device comprises:

a light source;

a waveguide for receiving light from the light source so that the light is caused to propagate through the waveguide; and a detector for detecting the light propagating through the waveguide to determine a change in the monitored structure, and for producing a detected signal.

Preferably the detector signal is also processed to determine level crossing rates in the signal and from those rates, distinguish between noise in the signal and the required event.

In one embodiment the number of level crossings in the detected signal when a required event is detected is determined by the processor and the predetermined features are selected from the group comprising:

the total number of level crossings over a specified time period;

the duration of the level crossings;

the slope of the falling edge of the level crossings; and the angle of the rising edge of the level crossings.

In one embodiment of the invention the processor has a classifier having a neural network for receiving the predetermined features and for determining the class of the event.

In another embodiment the processor has a linear classifier to define a boundary between classes of intrusion events so that an intrusion event is classified according to where the intrusion event as represented by the predetermined features occurs relative to the line.

In another embodiment of the invention the predetermined features are time frequency based features.

In this embodiment the features are determined by performing a fast Fourier transform on the signal during the event interval, determining a centre frequency and using a comparison of centre frequencies determined during the event to classify the event.

This aspect of the invention may be said to reside in method of monitoring a structure to determine the occurrence of a required event, comprising:

monitoring a change in the structure by a sensing device to provide a detected signal; and processing the detected signal and extracting predetermined features from the detected signal so that the classification of an event type can be determined from the predetermined features.

Preferably the monitoring step comprises:

launching light into a waveguide so that the light is caused to propagate through the waveguide;

detecting the light propagating through the waveguide to determine a change in the monitored structure, and for producing a detected signal.

Preferably the detector signal is also processed to determine level crossing rates in the signal and from those rates, distinguish between noise in the signal and the required event.

In one embodiment the number of level crossings in the detected signal when a required event is detected is determined, and the predetermined features are selected from the group comprising:

the total number of level crossings over a specified time period;

the duration of the level crossings;

the angle of the falling edge of the level crossings; and the angle of the rising edge of the level crossings.

In one embodiment a line to define a boundary between classes of intrusion events so that an intrusion event is classified according to where the intrusion event as represented by the predetermined features occurs relative to the line.

In another embodiment of the invention the predetermined features are time-frequency based features.

In this embodiment the features are determined by performing a fast Fourier transform on the signal during the event interval, determining a centre frequency and using a comparison of centre frequencies determined during the event to classify the event.

BRIEF DESCRIPTION OF THE DRAWINGS

A preferred embodiment of the invention will be described, by way of example, with reference to the accompanying drawings in which.

DETAILED DESCRIPTION OF THE PREFERRED EMBODIMENT

Figure 1:
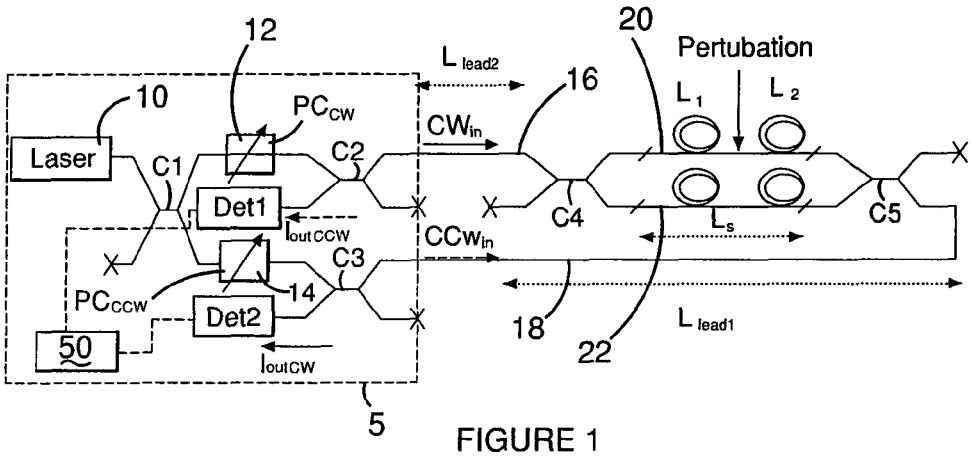
FIG. 1 is a block diagram of an apparatus for locating an event of an intrusion.

Referring to FIG. 1, the locator sensor locates perturbations on its sensing arms by using the difference in time of arrival of the counter propagating signals at Det1 and Det2. Additionally, using the event signals detected by both detectors (Det1 and Det2), it is possible to apply the appropriate signal processing techniques to classify the signals and perform both signal identification and signal discrimination.

By measuring and analysing the level crossing rates (LCR) of a number of different intrusion and nuisance event signals obtained from a number of installed locator systems in the field, the LCR can form the basis of both event signal recognition and discrimination techniques for reducing nuisance alarm rates. In particular, using the LCR technique with fence-mounted locator systems of the type described in the above US patents and application, zero nuisance alarm rates due to heavy rain have been achieved, as well as the accurate detection and location of intrusion events, such as climbing, during periods of heavy rain.

LCR (Level Crossing Rate) is defined as the number of times per unit duration that the envelope of a signal in the time domain crosses a given value in the positive direction.

The LCR technique is defined by the number of crossings (in the positive direction) of an input vector through a given threshold. The implemented LCR can be given by $$LCR = \sum_{n=0}^{N-1} \Psi\{(x(n) \geq a) \,\&\, (x(n-1) < a)\}$$

where x is a signal of length N, the parameter $^{a}$ is the level threshold, and the indicator function $\Psi\{K\}$ is 1 if its argument K is true, or 0 otherwise.

This can be applied to the event signals received by the fibre optic locator system described in FIG. 1, to extract the following LCR signal features: 1) the minimum LCR over a specified time period; 2) the maximum LCR over a specified time period; 3) the mean LCR over a specified time period; 4) the standard LCR deviation over a specified time period; and 5) the total LCR.

Any combination of these features can be used to determine fixed thresholds for defining particular nuisance events, whilst an adaptive threshold can be used to detect an intrusion event during a simultaneous nuisance event.

The use of the LCR technique described previously to detect and recognize nuisance signals caused by heavy rain on fence-mounted fibre optic intrusion detection systems, as well as the detection of climbing events during continuous periods of heavy rain is now described.

With reference to FIG. 1, the basic system as disclosed in the above-identified US patents and applications will be briefly described.

Light from a laser source 10 is launched into a coupler C1 which in turn launches the light into polarisation controllers for both the clockwise and counter clockwise directions 12 and 14 respectively. The light is then launched through couplers C2 and C3 into a lead in optical fibre 16 and a lead in optical fibre 18. The fibre 16 is connected to a coupler C4 so that the light from the lead-in fibre 16 propagates through sensing fibres 20 and 22 in the clockwise direction and then through a coupler C5 to the lead in fibre 18 and back through coupler C3 to detector Det2. Light from the fibre 18 is received by coupler C5 and launched in the counter clockwise direction into the sensing fibres 20 and 22 and propagates through the coupler C4 to the lead-in fibre 16 and through coupler C2 to the detector Det1.

The detectors Det1 and Det2 are connected to a processor 50 schematically shown in controller unit 5 of FIG. 1 so that, in accordance with the above US patents and US patent application, the signals are processed to determine when an event occurs and the location of that event.

According to the preferred embodiments of the present invention, the processor 50 also discriminates between events such as various different classes of required events such as cutting or climbing a fence, as well as different nuisance events caused by rain, wind and other environmental activity, as well as other nuisance events such as the throwing of stones against a fence or other human caused nuisance events.

The processor 50 discriminates between the nuisance events and an actual intrusion event so that only intrusion events are made the subject of an alarm to identify an intrusion or other event which is of interest, as well as providing information as to the specific nature of the nuisance events which are being caused.

The manner in which nuisance events are discriminated from actual required events will be described with reference to FIGS. 2 to 8.

Figure 2:
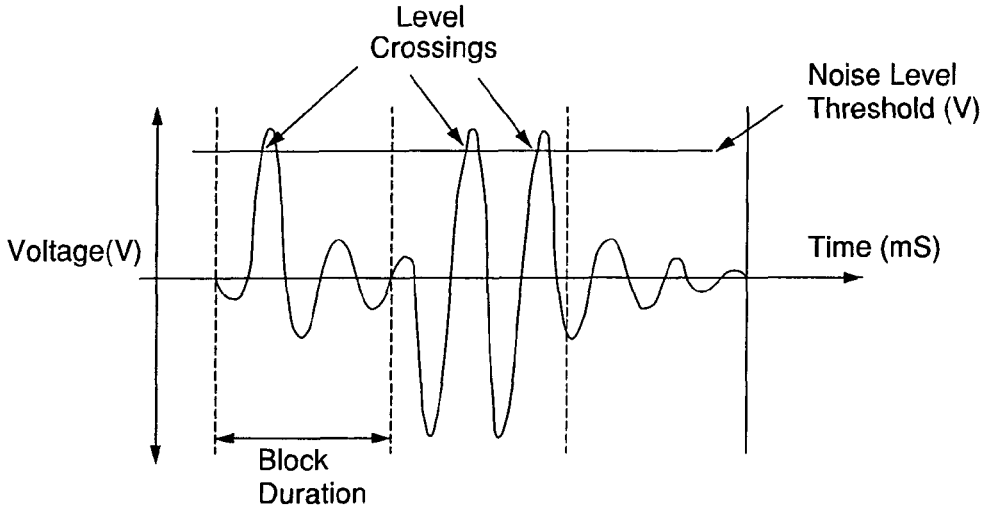
FIG. 2 is a graph showing parameters used in a level crossing rate technique used in the invention.

With reference to FIG. 2, a time domain signal is shown which is received from the fibre optic sensor (such as fibre 18 via detector Det2) that is being acquired at a sampling rate of approximately 40 kHz. The signals are divided up into block durations, or "Blocks" of a fixed duration (say 10 ms).

For each block the number of signal "Level Crossings" is counted. A "Level Crossing" is said to have taken place when the acquired signal goes from below a specified "Noise Level Threshold" to above that threshold. The "Noise Level Threshold" is set to be just above the background system noise and, for example, can be set to 0.085 volts by the processor 50 if the system noise is 0.083 volts.

The number of "Level Crossings" for each "Block" is then monitored to allow the signal to be classified according to predetermined criteria. An "Event", that is, an intrusion event, is said to have occurred when the number of Level Crossings within a block goes above a specified "Event Threshold" (see FIG. 5).

Figure 3:
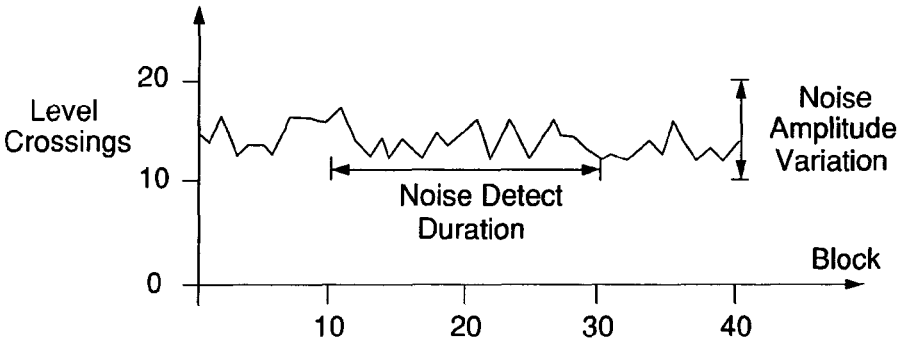
FIG. 3 is a graph showing level crossings per defined blocks in a noise induced environment.

The number of "Level Crossings" per block is monitored for a period of time known as the "Noise Detect Duration" (FIG. 3). Using the fibre optic based intrusion detection system described in FIG. 1, analysis of nuisance signals caused by heavy rain periods have shown that a relatively constant range of level crossings per block is maintained during the rainy periods. This range is defined as the "Noise amplitude variation". If over the "Noise Detect Duration" period the number of level crossings does not vary by more than the "Noise amplitude variation", then the signal over this period of time is assumed to be caused by heavy rain, and therefore alarms during this period can be ignored. A similar approach can be applied to other nuisance events such as wind or nearby traffic events caused by vehicular or train crossings.

FIG. 3 shows a typical plot of the level crossings per block for a signal caused by heavy rain on a fence mounted fibre optic intrusion detection sensor. The Noise Detect Duration is equivalent to 20 blocks (if a block had a duration of 10 ms then the noise detect duration would be 200 ms). In this case the Noise amplitude variation has been set to 10. It can be seen that the number of "Level Crossings" per "Block" have not varied by more than the "Noise amplitude variation" over the "Noise Detect Duration" period. The signal related to these level crossings is therefore considered as Background Environmental Noise, and any alarms it produces are handled accordingly and not treated as an event alarm.

Figure 4:
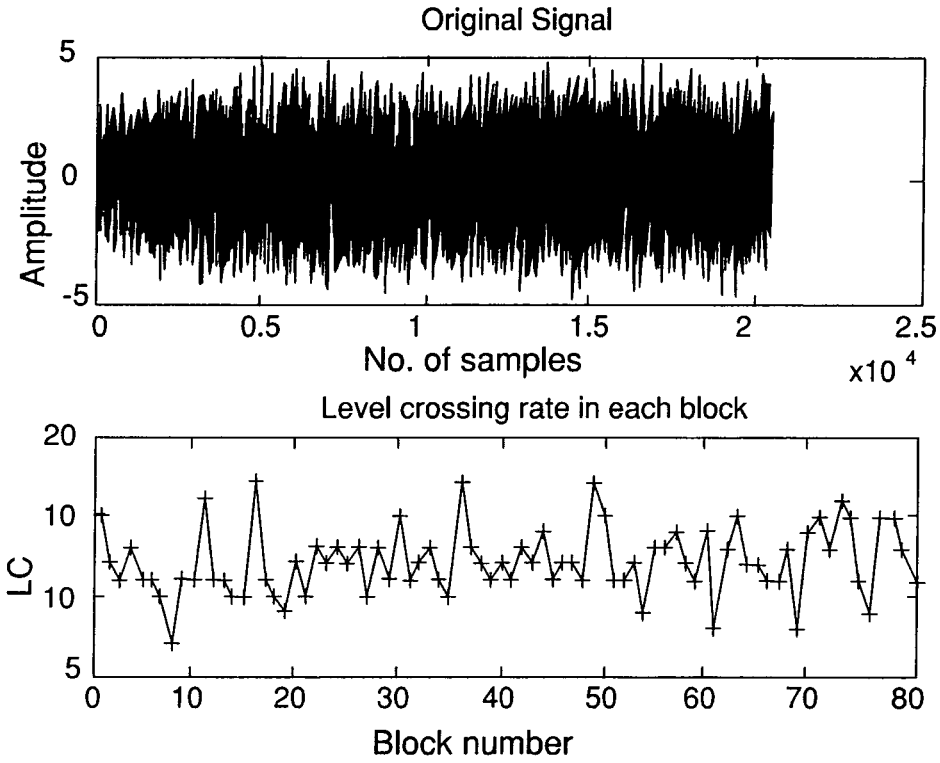
FIG. 4 is graphs showing time domain representation of a heavy rain nuisance event and level crossings per block.

An example of a heavy rain nuisance signal as obtained from a fence mounted fibre optic locator system is shown in FIG. 4. A plot of the level crossings per block (LCR) versus block number is also shown. The heavy rain nuisance signal, which is continuous, shows a consistent LCR count with a relatively small variation. These features can be used to detect and identify heavy rain induced nuisance alarms.

A required event (or intrusion event) is said to have occurred when the number of "Level Crossings" in a given block goes above an "Event Threshold". The "Event Threshold" is dynamic as it changes depending on the amount of Background Environmental Noise currently in the system, which can change as the intensity of the rain varies.

Whenever a new block is received, the method and apparatus determine whether or not the signal is just background noise. If the signal is just background noise then the current "Event Threshold" is updated. The new "Event Threshold" will equal the maximum "Level Crossing" count over the last "Noise Detect Duration" plus the "Event Threshold Margin".

Figure 5:
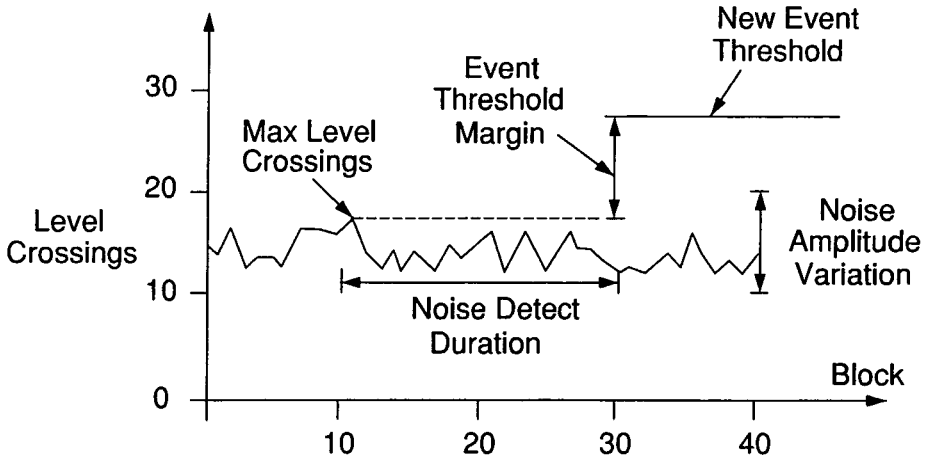
FIG. 5 is a graph showing the result of dynamically determined event thresholds.

FIG. 5 shows how the "Event Threshold" which is updated after the $30^{th}$ block has been processed. In the example above the maximum number of level crossings over the last "Noise Detect Duration" is 18. The "Event Threshold Margin" is set in the processor 50 to be 10. As the variation of level crossings over the last "Noise Detect Duration" has not varied by more than the "Noise amplitude variation" the "Event Threshold" is updated to 18 plus 10. In this example the new "Event Threshold" is set to 28. This allows the Event threshold, that is, the threshold above which an event will be recognized as an intrusion event, to dynamically change with any variation in the maximum level crossings which may occur as the intensity of the rain varies.

Figure 6:
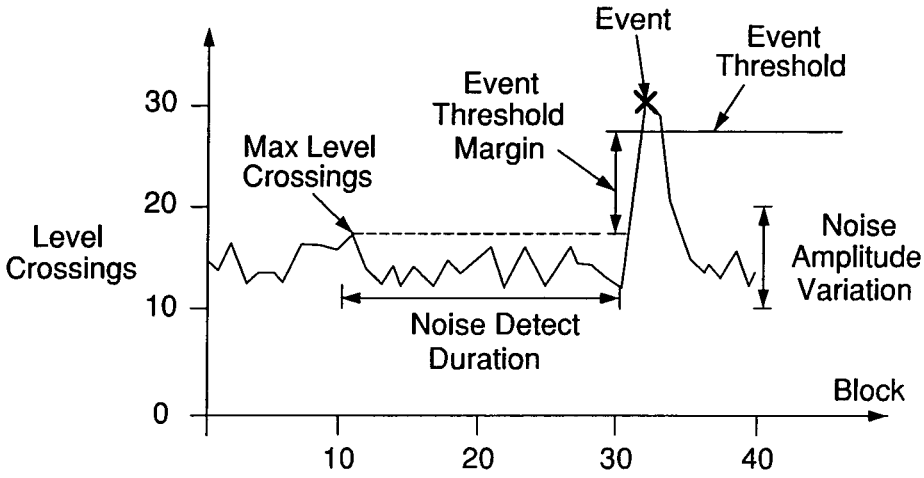
FIG. 6 is a graph showing detecting of an intrusion event during heavy rain periods.

FIG. 6 shows an example of an event being detected in the $31^{st}$ block of data received. The intrusion event essentially increases the number of level crossings in the detected time domain signal above the background level crossings caused by the heavy rain allowing for the intrusion event to be detected and recognized. In the case of the fibre optic based locator system shown in FIG. 1, it also allows for the correct part of the signal to be processed for an accurate event location to be determined. The LCR technique therefore can also be used as an effective method for the discrimination between intrusion events and nuisance events.

Figure 7:
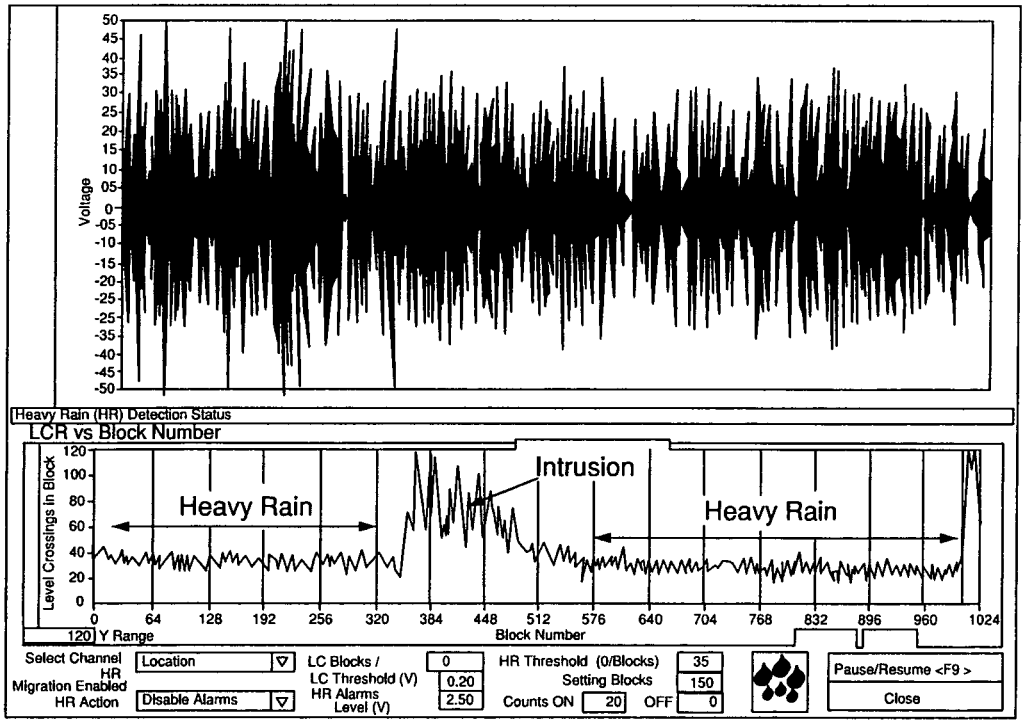
FIG. 7 is diagrams of actual screen displays showing detection identification of an intrusion event.

An example of detecting and identifying an intrusion event during a heavy rain period using the locator intrusion detection system on a 1.6 km fence perimeter is shown in FIG. 7.

The example in FIG. 7 shows the detection of an intrusion event during a manually stimulated background nuisance event on a 1.6 km long sensing system according to the above embodiment. The dynamic Event Threshold adjusts itself to cater for any variation in the level crossings of the nuisance signal.

The LCR technique described above can also be applied to other nuisance events such as wind, vehicle traffic and train traffic.

Figure 8:
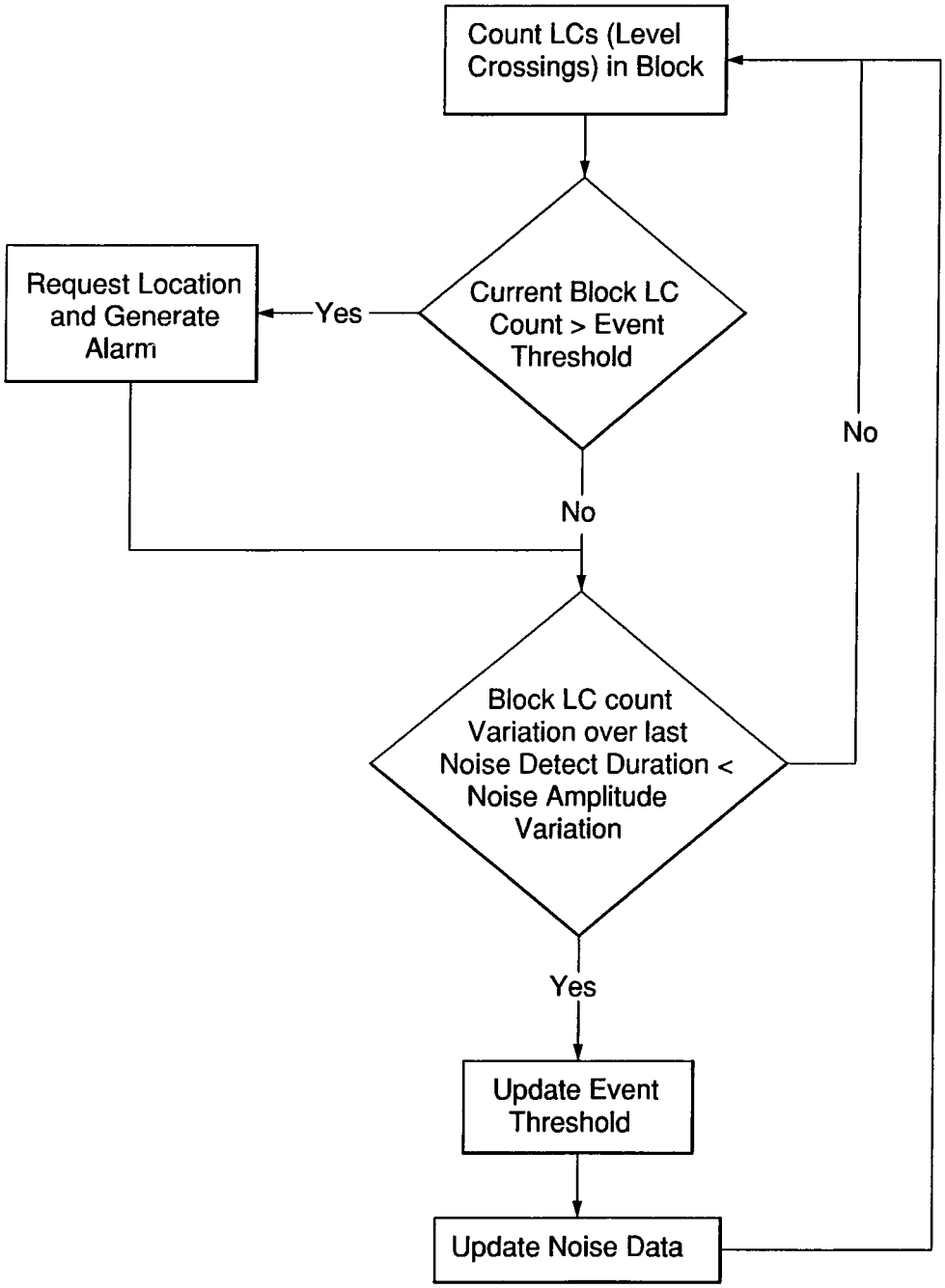
FIG. 8 is a flow chart illustrating the operation of the system according to the preferred embodiment for discriminating between nuisance events and required events such as an intrusion.

FIG. 8 is a flow chart showing the detection of an event and the adjustment of the various threshold levels to resulting nuisance events such as rain etc from generating required event alarms. As shown in FIG. 8 the level crossings in a block is counted and if the number of level crossings is greater than the event threshold an alarm is generated indicative of an actual required event to alert the system operator that an intrusion or other event has occurred. The process then goes to the next step in which the variation of the level crossing count per block is compared to the noise amplitude variation. If the answer is no the system goes back to the start and the level crossings are again counted. If the answer is yes the system goes to the next step in which the event threshold is updated. A pure nuisance data record is also updated for use in the embodiment of FIG. 11. The system then goes back to the start where the number of level crossings are again counted in each block.

Figure 9:
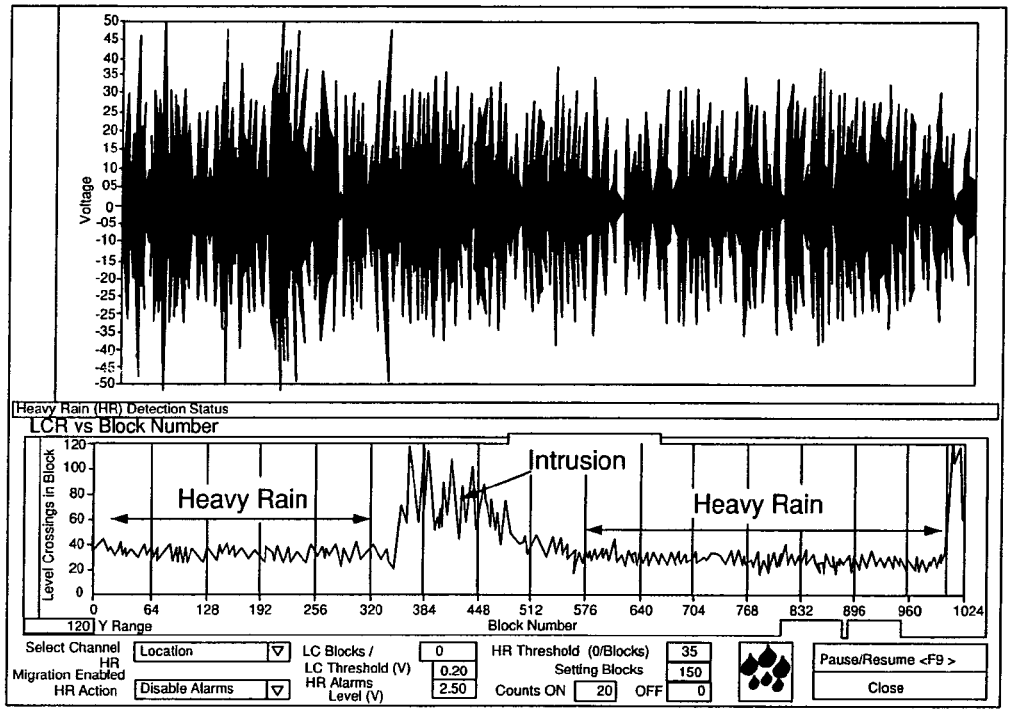
FIGS. 9 and 10 are diagrams showing actual display screens giving an example of the identification of an event during artificially stimulated background noise events to show the dynamic event threshold.
Figure 10:
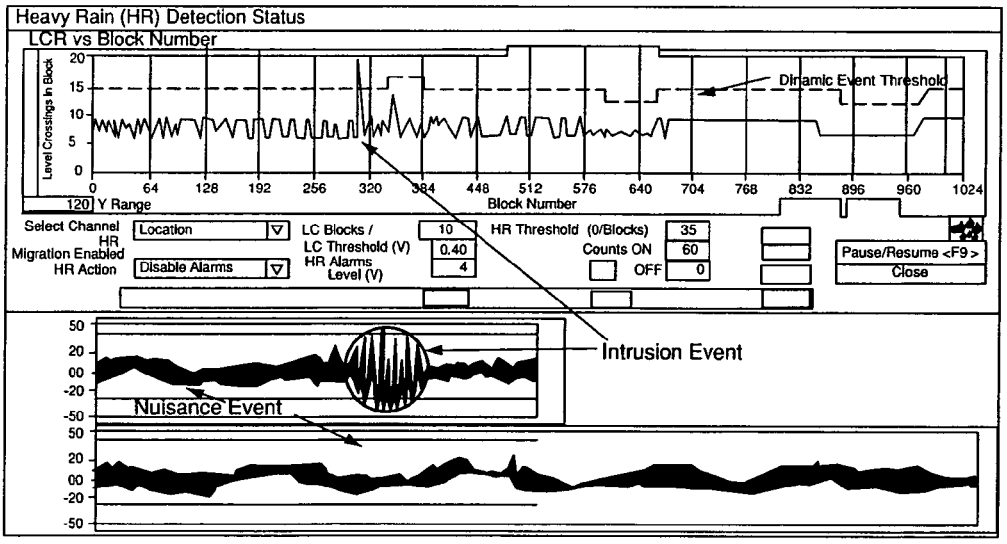

With reference to FIGS. 9 and 10 diagrams illustrating actual screen displays are shown in which in FIG. 9 the upper part of the display shows a combined nuisance-intrusion event time domain signal whilst the lower part of the display shows the level crossings per block versus block number. FIG. 10 shows the dynamic event threshold which adjusts itself to cater for any variations in the level crossings caused by the nuisance signals. As can be seen in FIG. 10 the dynamic event threshold raises and lowers with the background nuisance event so that the system and method according to preferred embodiments is continually self-adjusting when a rain event occurs to raise the dynamic event threshold so that the rain does not cause the generation of event alarms indicative of an intrusion, and again lowers itself when the rain reduces. Thus, the preferred embodiment effectively provides a system in which the mode of operation changes depending on the environmental nuisance noise to which the system is subject at any particular time. When rain occurs the system effectively switches to a mode in which the event threshold is raised so that the rain does not cause event alarms and when the rain ceases the system goes back to its normal state with the event threshold lowering.

Figure 11:
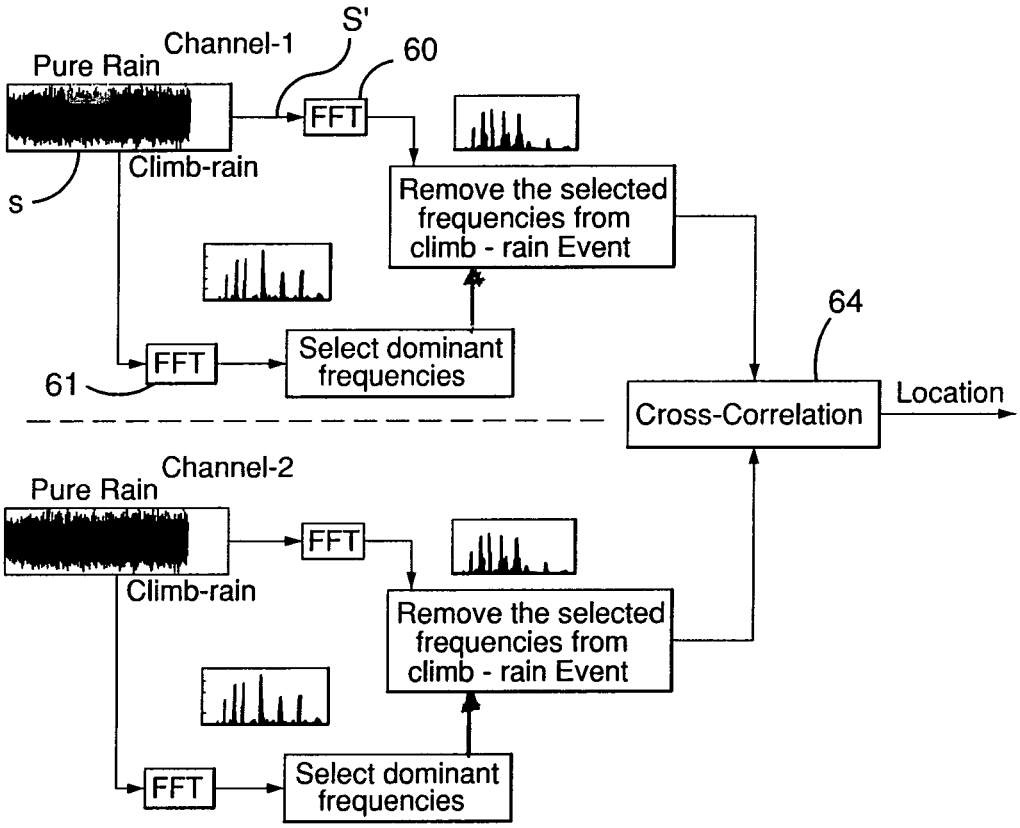
FIG. 11 is a block diagram showing a second embodiment of the invention.

FIG. 11 shows a second embodiment of the invention using a Frequency Domain Denoising (FDD) method.

In some situations, the contribution of the nuisance signal to the combined nuisance-event signal can affect the accuracy of the location calculation in the locator sensing system. This is especially the case when the background nuisance or noise signal forms a significant part of the overall signal.

The Frequency Domain Denoising (FDD) method reduces the amount of background nuisance or noise level in the combined nuisance and intrusion event signal and improves the event signal's signal-to-noise ratio (SNR). This method is used in conjunction with the LCR technique described earlier to characterize both the nuisance or noise background signal, and to identify when the event signal of interest occurs.

As an example, the FDD approach for extracting an event signal from a strong background nuisance heavy rain signal is summarised as follows:

1. Monitor the time domain signal and its LCR during heavy rain.
2. If the LCR exceeds the Event Threshold it means that an intrusion event (such as a climb event) has occurred during heavy rain. Identify the block(s) of data which corresponds to the intrusion event
3. Locate a block of data before the event that characterizes the pure rain event and convert it into the frequency domain using a Fast Fourier Transform (FFT).
4. Select some of the dominant frequencies from the FFT representation of the rain block. A threshold based on a percentage of the maximum peak in the FFT graph is used to select these frequencies.
5. After selecting the dominant frequencies of the rain signal, remove these frequencies from the block(s) which contains the combined intrusion and rain signal.

With reference to FIG. 11 as mentioned above, the time domain signal shown in FIG. 2 is monitored and the level crossing rate is used to determine whether a nuisance event such as rain is occurring. If the level crossing rate exceeds the event threshold, in the manner described above, an intrusion event is also occurring. As shown in FIG. 11 signal S from one of the detectors Det1 or Det2 indicative of the nuisance event (i.e. rain) and/or the required intrusion event (such as a fence climb event) is also occurring. A signal indicative of the pure nuisance signal such as that caused by the rain event without an actual intrusion is supplied to a fast Fourier transform algorithm 61 and a fast Fourier transform is performed on the signal to determine selected frequencies within the pure nuisance signal. A signal S' within the block or blocks in which a combined nuisance-intrusion event has occurred is also supplied to a fast Fourier transform algorithm 60 and a fast Fourier transform is performed on that signal. Thus, the signals supplied to the algorithms 60 and 61 are converted to the frequency domain using the fast Fourier transform. The processor 50 removes all or a significant proportion of the selected frequencies from the pure nuisance frequency domain signal produced by the algorithm 61 from the frequency domain signal produced by the algorithm 60. This signal is therefore supplied to the cross correlation circuit 64 and is indicative of the pure event signal which is of interest. In FIG. 11 channel 1 represents the clockwise MZ output signal propagating in the fibre 18 and channel 2 represents the counterclockwise MZ output signal propagating in the fibre 16. The channel 2 signal is processed in exactly the same way as the channel 1 signal so that its actual intrusion signal is supplied to the cross correlation circuit 64 so that the fact that an event has occurred can be determined and its location also determined.

This technique essentially removes a significant amount of the background nuisance or noise contribution from the combined nuisance-intrusion signal which in effect extracts the intrusion component from the total signal. FIGS. 12 to 23 relate to an embodiment of the invention in which an actual required intrusion event is classified so the event can be determined as a particular type of event such as an intrusion caused by climbing over a fence, or some other event such as throwing stones at the fence.

Figure 12:
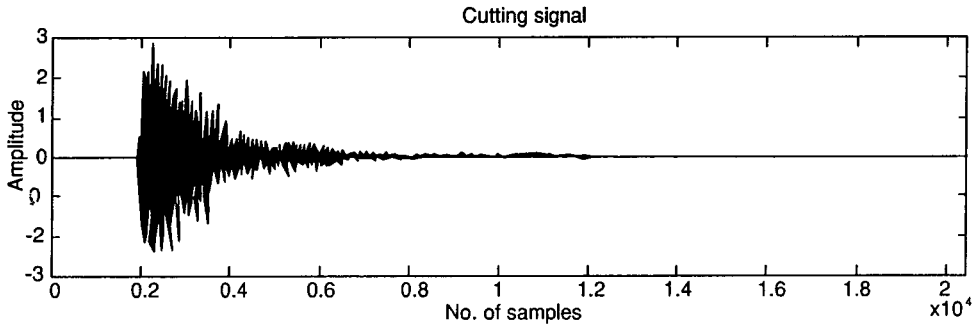
FIG. 12 is a display showing the effect of an intrusion event caused by cutting a fence on a signal detected by one embodiment of the invention used to classify the intrusion event.

Different types of intrusions can be identified since they can generate unique vibration signals with different signatures. FIG. 12 is a display showing the effect of cutting a fence on the signal detected by one of the detectors Det1 or Det2 in FIG. 1. As shown in FIG. 12 the signal has a very sharp rise and then decays over time.

Figure 13:
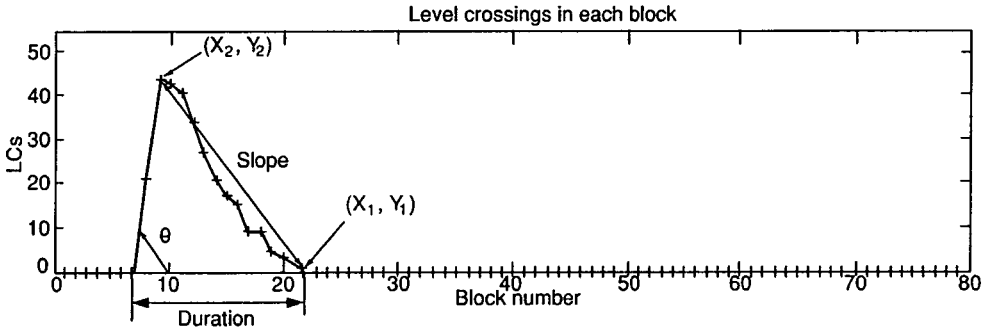
FIG. 13 is a representation of various features extracted from the display of FIG. 12.

FIG. 13 is a graph showing the number of level crossings for each block duration. As is shown in FIG. 13 when the cutting event starts there is a large number of level crossings for example, at block 10 and the number decreases until block 20 where the number is zero.

Four features are extracted from FIG. 13 being;

the total number of level crossings over a specified time period;

the duration of the level crossings;

the angle of the falling edge of the level crossings; and the angle of the rising edge of the level crossings, θ as shown in FIG. 13.

In FIGS. 12 and 13 the total number of level crossings measures the area under the level crossings versus block number graph over a specified period of time. In the example shown in FIGS. 12 and 13, the length of the proposed data was set to 2480 samples, sampled at 40 Khz. The duration of the level crossings is the number of consecutive blocks that have values greater than zero. The slope of the level crossings is the slope of the falling edge of the graph shown in FIG. 13 which shows the points $x_1$, $y_i$ and $x_2$, $y_2$ from which the slope is determined.

The slope is therefore given by $(y_2-y_i)$ divided by $(x_2-x_1)$.

Figure 14:
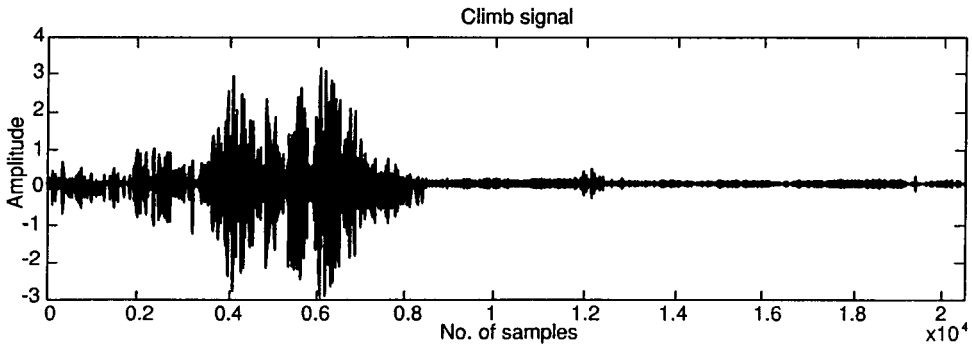
FIG. 14 is a display showing an intrusion event caused by climbing a fence.
Figure 15:
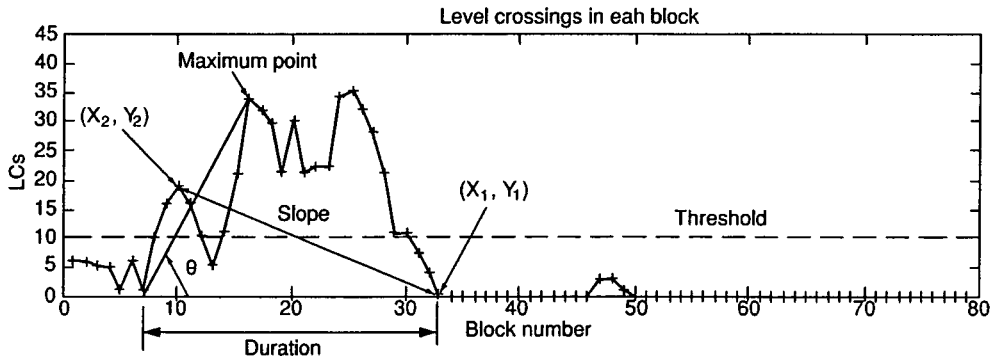
FIG. 15 is a graph showing extracted features from the display of FIG. 14.

FIGS. 14 and 15 are similar to FIGS. 12 and 13 except that they show a climbing event. In FIG. 15 a threshold has been used to select one of the slope points for the falling edge which is the first peak in FIG. 15 above the threshold and the maximum point in FIG. 15 is used to determine the angle of the rising edge 8.

As is apparent from FIGS. 13 and 15 the rising edge in a cutting event forms approximately a right angle with the x-axis, whilst the rising edge for a climbing event forms an acute angle less than 90°. This feature is very important for climbing and cutting classification.

Figure 16:
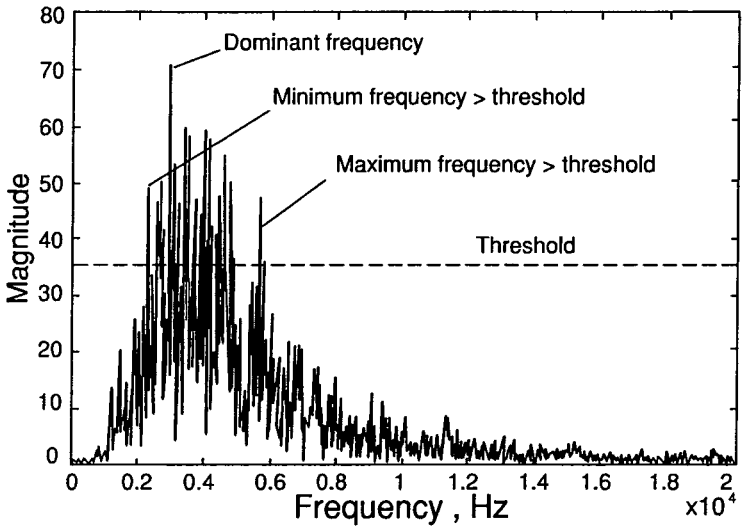
FIG. 16 is a graph showing a frequency spectrum of a detected event.

In one embodiment shown in FIG. 16 a time-frequency based classification system is used in which a fast Fourier transform is performed over the intrusion event time interval. The fast Fourier transform is performed only over the detected intrusion intervals and not over the entire domain signal. The features extracted with this method are summarized as follows:

detection of the intrusion event interval;

the fast Fourier transform spectrum is calculated for the detected event;

for the frequency spectrum of the intrusion event, a threshold is selected. In the example of FIG. 16, the threshold is 50% of the peak magnitude of the spectrum;

the minimum frequency and maximum frequencies above that threshold are selected and the centre frequency is calculated by $(f_{min})$ $(f_{max})$ divided by 2; and the centre frequency calculation is repeated for successive detected events over time.

Figure 17:
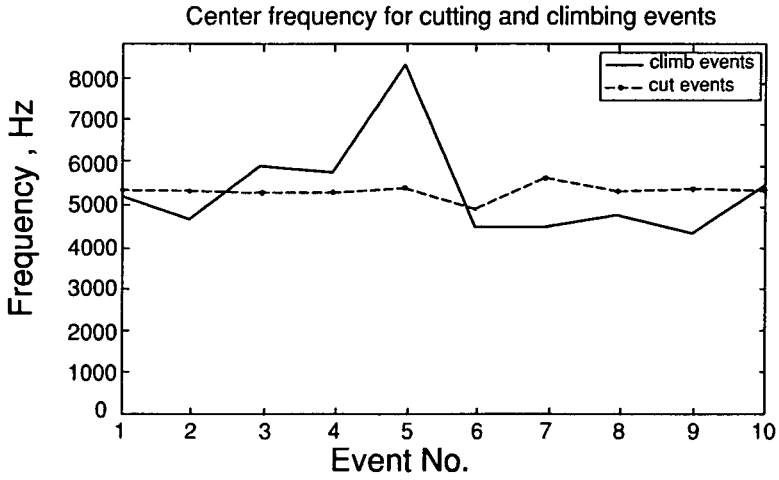
FIG. 17 is a graph showing the difference between a intrusion event caused by cutting and an intrusion event caused by climbing over a fence.

FIG. 17 shows a comparison of the centre frequencies of 10 fence cut and fence climb events. The fence cutting events have a more consistent centre frequency when compared to the climbing events. This feature can be used in conjunction with the previous features to confirm the presence of cutting events.

After extraction of the feature vectors from the signal, decision is then taken about the class the signal belongs to (whether cutting or climbing event). This process is performed with an appropriate classifier such as a neural network. For every point in a feature space, a corresponding class is defined by mapping the feature space to the decision space. The borders between the classes are formed by training the neural network. This is done with a suitable set of cut and climb event data. Once borders are fixed with a set of training data, the performance of the classifier is tested with a set of test events (cut and climb) that is independent of the training set.

The extracted level crossing base features described previously for the cutting and climbing events can be used as inputs to the neural network. The neural network is efficient regardless of data quantities. Neural networks can learn from examples and once trained, are extremely fast algorithms making them suitable for real time application. Event classification by a neural network does not require any statistical assumptions regarding the data. The network learns to recognize the characteristic features of the data to classify the data efficiently and accurately.

In another embodiment of the invention a linear classifier can be used to classify events such as a stone-throwing event, fence cutting event or fence climbing event. The purpose of this classifier is to set boundaries between various classes and this type of classifier is suitable for classes, that is particular events, that have little or no overlap between them for a set of given features.

Figure 18:
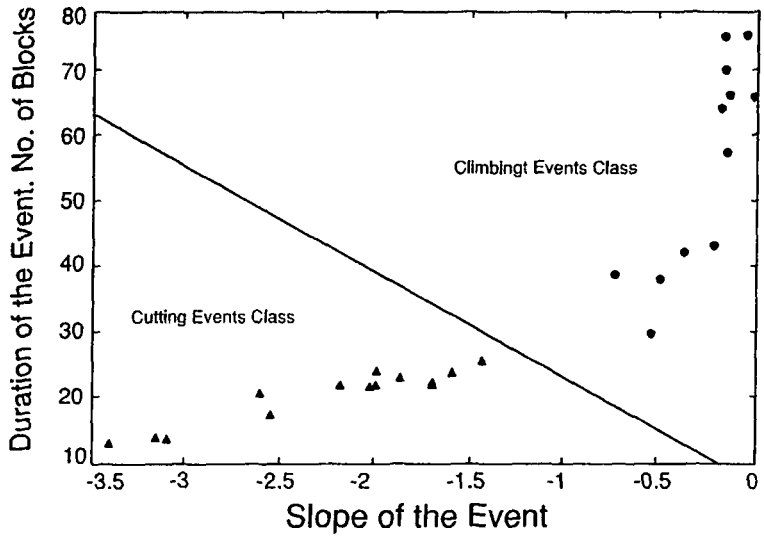
FIGS. 18, 19, 20, 21, 22 and 23 are graphs showing the classification and recognition of various events.
Figure 19:
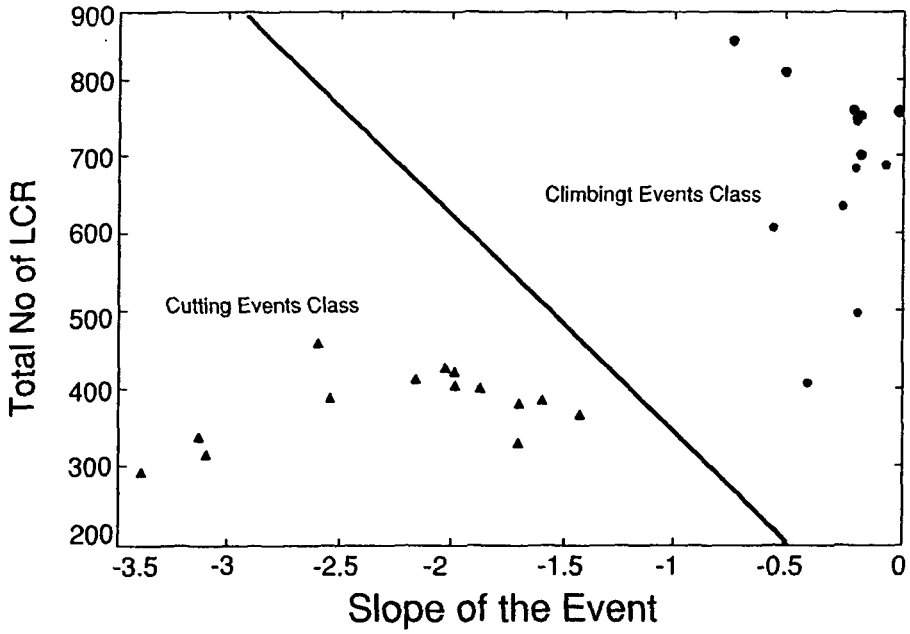
Figure 20:
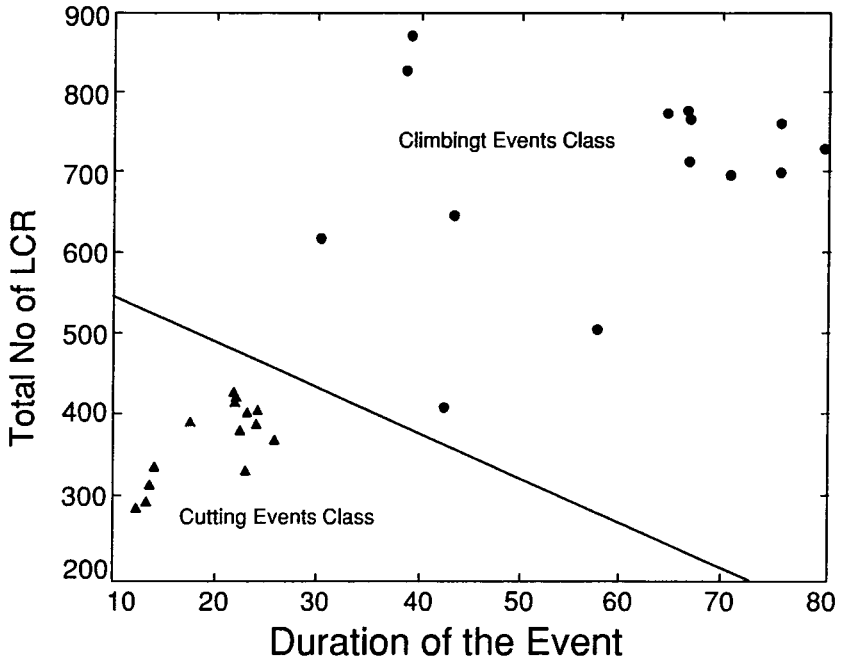

FIGS. 18 to 20 show the classification and recognition of cutting and climbing events using different combinations of features. The two dimensional features for these figures respectively are:

event duration versus slope of the event;

total level crossings versus slope of the events; and total level crossings versus duration of the events.

As can be seen from FIG. 18 cutting events are below the line in FIG. 18 and climbing events above the line. Thus, an event which falls above the line in FIG. 18 can be classified as a climbing event and that which falls below the line as a cutting event.

Similar comments apply to FIGS. 19, 20, 21 and 22.

In FIG. 18 classification and recognition is performed using slope and duration of the events, in FIG. 19 slope and total level crossings of the events is used, in FIG. 20 duration and total level crossings of the events is used.

Figure 21:
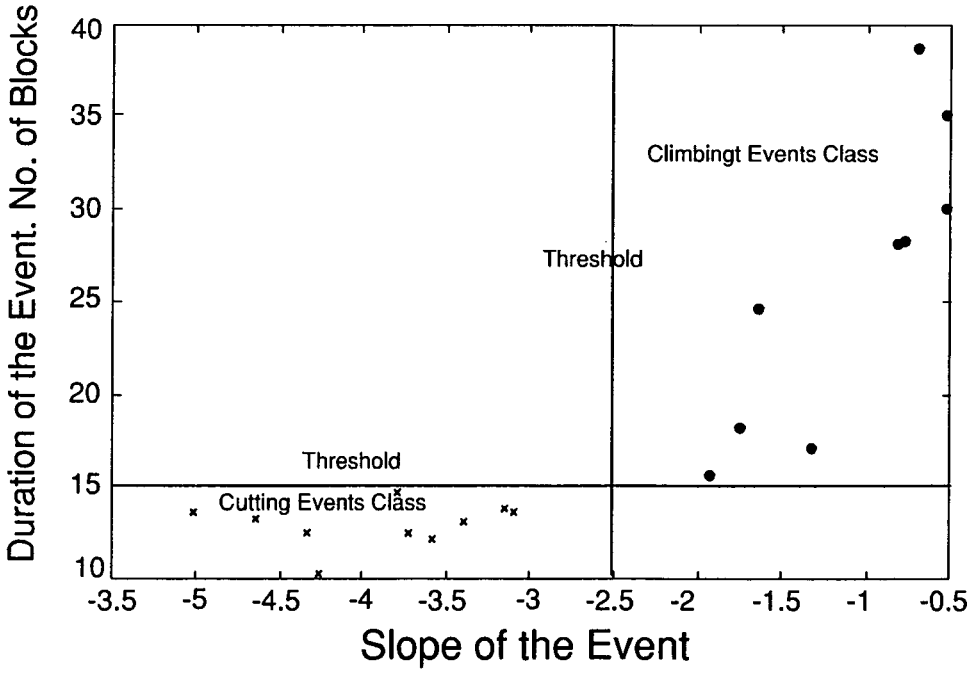

FIG. 21 shows the use of horizontal and vertical threshold lines to separate cutting events and climbing events.

Figure 22:
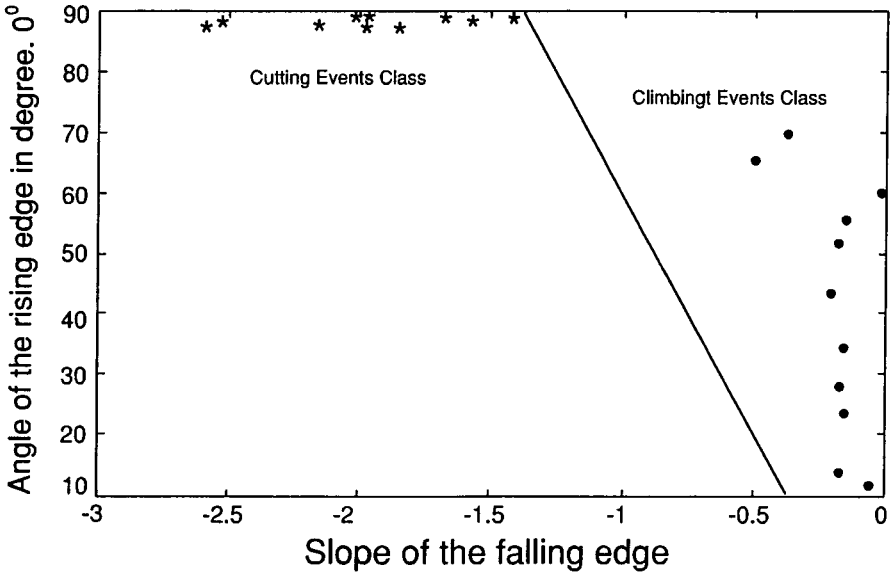

FIG. 22 shows the classification and recognition of cutting and climbing events using the angle of the rising edge of the level crossings versus the slope of the falling edge of the level crossings.

Figure 23:
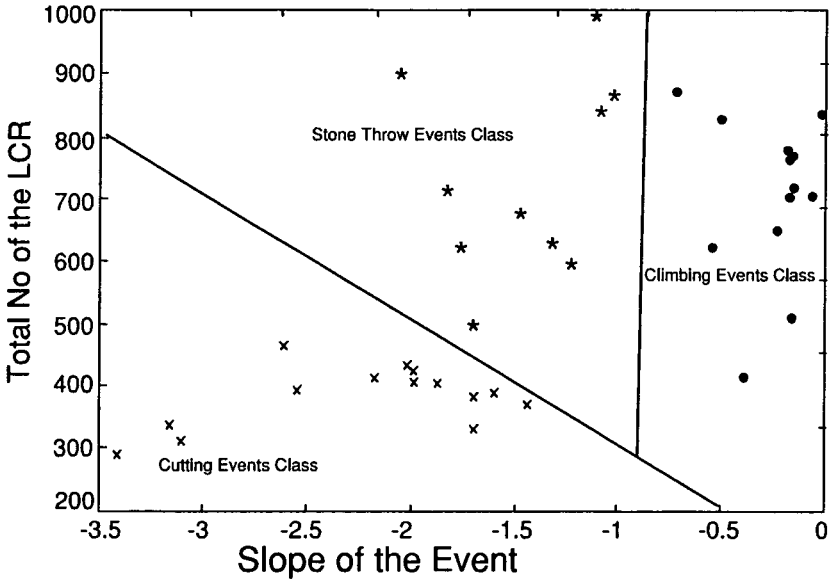

FIG. 23 shows classification and recognition of three events being the cutting and climbing events previously described and a stone throwing event. The results show that the stone throwing events have comparable slope with the cutting events but different in their total level crossing rate. Also, FIG. 23 shows that some of the stone events share similar total level crossings with climb events but differ in their slopes.

It will be understood to persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An apparatus for monitoring a structure against intrusion comprising:

a sensing device for producing a detected signal for determining a change in or to the structure;

a processor for processing the detected signal to distinguish between noise in the signal indicative of a nuisance event and an intrusion event;

wherein the processor is configured to analyse the detected signal over successive noise detection time intervals, each having a plurality of successive time block durations, to derive, for each block duration, a count of the number of level crossings, the count being the number of times the signal crosses a noise level threshold in a direction during the block duration, regard the signal as indicative of a nuisance event upon the count in each time block duration of a noise detection time interval being within a noise amplitude variation range, the noise amplitude variation range being a permitted range of variation in the number of level crossings per time block duration, generate an alarm upon the count being in excess of a current event threshold in any time block duration, the current event threshold level being a number of level crossings per time block duration that indicates that an intrusion event has occurred, the current event threshold having been set as a number of level crossings in excess of a maximum number of level crossings within the noise amplitude variation range that occurred within a noise detection interval, maintain a current event threshold upon the count in a time block duration of a noise detection time interval being outside a noise amplitude variation range and below the event threshold, and set a new event threshold to apply in a subsequent block duration upon each count in any time block duration of a noise detection time interval being within the noise amplitude variation range.

2. The apparatus of claim 1 wherein the processor is configured to set the new event threshold level to the maximum number of level crossings per time block duration occurring during a the noise detection time interval plus an event threshold margin.

3. The apparatus of claim 2 wherein the event threshold margin is a predetermined margin.

4. The apparatus of claim 1, wherein the sensing device includes a light source;

a waveguide for receiving light from the light source so that light is caused to propagate through the waveguide; and a detector for detecting the light propagating through the waveguide to determine a change in the monitored structure, and for producing the detected signal.

5. A method of monitoring a structure against intrusion comprising:

monitoring a change in the structure by a sensing device to provide a detected signal;

analyzing the detected signal over successive noise detection time intervals, each interval having a plurality of successive time block durations, to derive, for each block duration, a count of the number of level crossings, the number of level crossings being the number of times the signal crosses a noise level threshold in a direction to exceed the threshold during the block duration;

regarding the signal as indicative of a nuisance event upon the count in each time block duration of a noise detection time interval being within a noise amplitude variation range, the noise amplitude variation range being a permitted range of variation in the number of level crossings per time block duration;

generating an alarm upon the count being in excess of a current event threshold in any time block duration, the current event threshold level being a number of level crossings per time block duration that indicates that an intrusion event has occurred, the current event threshold having been set as a number of level crossings in excess of a maximum number of level crossings within the noise amplitude variation range that occurred within a noise detection time interval;

maintaining a current event threshold upon the count in a time block duration of a noise detection time interval being outside a noise amplitude variation range and below the event threshold, and setting a new event threshold to apply in a subsequent block duration upon the count in each time block duration of a noise detection time interval being within the noise amplitude variation range.

6. The method of claim 5 wherein the monitoring step comprises launching light into a waveguide and detecting light from the waveguide to provide the detected signal.

7. The method of claim 5, comprising setting the new event threshold to the maximum number of level crossings per time block duration occurring during the noise detection time interval plus an event threshold margin.

8. The method of claim 7 wherein the event threshold margin is a predetermined margin.

* * * * *

UNITED STATES PATENT AND TRADEMARK OFFICE

CERTIFICATE OF CORRECTION

PATENT NO. : 8,704,662 B2
APPLICATION NO. : 12/594266
DATED : April 22, 2014
INVENTOR(S) : Mahmoud et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1027 days.

Signed and Sealed this
Twenty-ninth Day of September, 2015

Michelle K. Lee

Michelle K. Lee
*Director of the United States Patent and Trademark Office*